United States Patent [19]

Davis

[11] Patent Number: 4,664,038

[45] Date of Patent: May 12, 1987

[54] DOOR LATCH CONTROL APPARATUS FOR HOPPER VEHICLE

[75] Inventor: Edward L. Davis, Youngstown, Ohio

[73] Assignee: General American Transportation Corporation, Chicago, Ill.

[21] Appl. No.: 512,525

[22] Filed: Jul. 11, 1983

[51] Int. Cl.[4] ..... B61D 7/18; B61D 7/26

[52] U.S. Cl. ..... 105/308.1; 105/286; 105/250; 292/108; 292/336

[58] Field of Search ..... 105/286, 287, 304, 280, 105/247, 250, 308 E, 308 R, 308 P, 308 B, 308.1; 292/108, 336

[56] References Cited

U.S. PATENT DOCUMENTS

| | | | |
|---|---|---|---|
| 917,182 | 4/1909 | Stewart | 292/99 |
| 1,041,864 | 10/1912 | Ostrander | 105/31 |
| 1,050,922 | 1/1913 | Davis | 292/336 |
| 1,075,367 | 10/1913 | Merritt | 292/99 |
| 1,286,593 | 12/1918 | Ingoldsby et al. | 105/288 |
| 1,489,965 | 4/1924 | Prentice | 292/129 |
| 1,596,935 | 8/1926 | Marshall | 160/211 |
| 1,636,746 | 7/1927 | Klumpp | 105/341 |
| 1,651,048 | 11/1927 | Talbot | 292/336 |
| 1,847,516 | 3/1932 | Knepper | 105/308 R |
| 2,149,949 | 3/1939 | Austin | 298/35 M |
| 2,294,683 | 9/1942 | Murphy | 292/99 |
| 2,375,896 | 5/1945 | Cox | 296/19 |
| 2,544,682 | 3/1951 | Hilgeman | 292/198 |
| 2,594,511 | 4/1952 | Steele | 292/336 |
| 2,790,666 | 4/1957 | Vanderveld | 292/336 X |
| 2,810,358 | 10/1957 | Dorey | 105/309 |
| 2,943,878 | 7/1960 | Rigaud | 292/44 |
| 3,240,523 | 3/1966 | Heimann | 292/198 |
| 3,625,159 | 12/1971 | Radey et al. | 105/241 C |
| 3,710,729 | 1/1973 | Schuller | 105/240 |
| 3,884,056 | 5/1975 | East et al. | 70/100 |
| 3,931,768 | 1/1976 | Price et al. | 105/240 |
| 4,061,371 | 12/1977 | Prather et al. | 292/198 |
| 4,062,575 | 12/1977 | Robins | 292/67 |
| 4,084,515 | 4/1978 | Kunz et al. | 105/240 |
| 4,132,177 | 1/1979 | Funk | 105/310 |
| 4,365,831 | 12/1982 | Bourne | 292/229 |

*Primary Examiner*—Randolph A. Reese
*Assistant Examiner*—Glenn B. Foster
*Attorney, Agent, or Firm*—Emrich & Dithmar

[57] ABSTRACT

A hopper vehicle has a hopper door movable between open and closed positions and carrying a door latch movable between latching and unlatching configurations with respect to a keeper on the hopper vehicle. A secondary latch on the door is pivotally movable between a latched condition engageable with a keeper on the door latch for holding it in its unlatching configuration and an unlatched condition accommodating movement of the door latch between its latching and unlatching configurations. A spring urges the secondary latch toward its latched condition and an actuator plate on the hopper vehicle drives the secondary latch to its unlatched condition in response to movement of the door to its closed position. Thus, the door latch is held in its unlatching configuration except when the door is closed.

12 Claims, 6 Drawing Figures

Fig 1
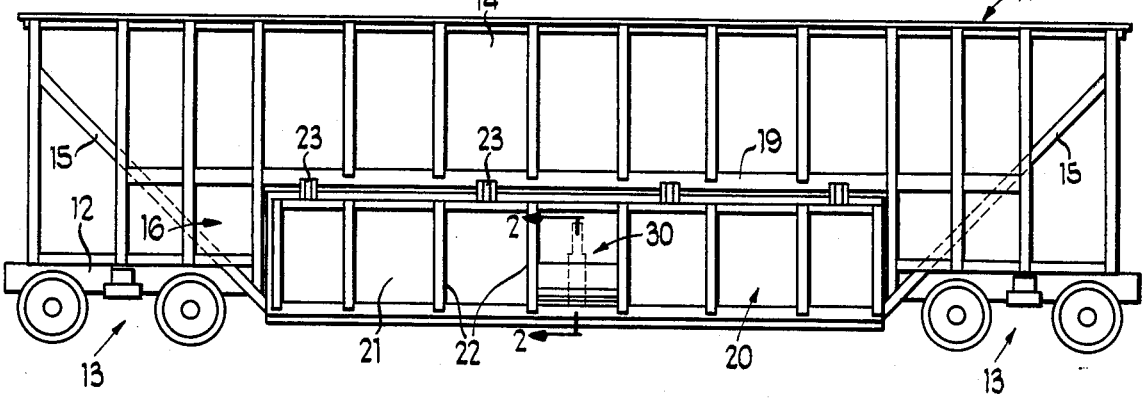
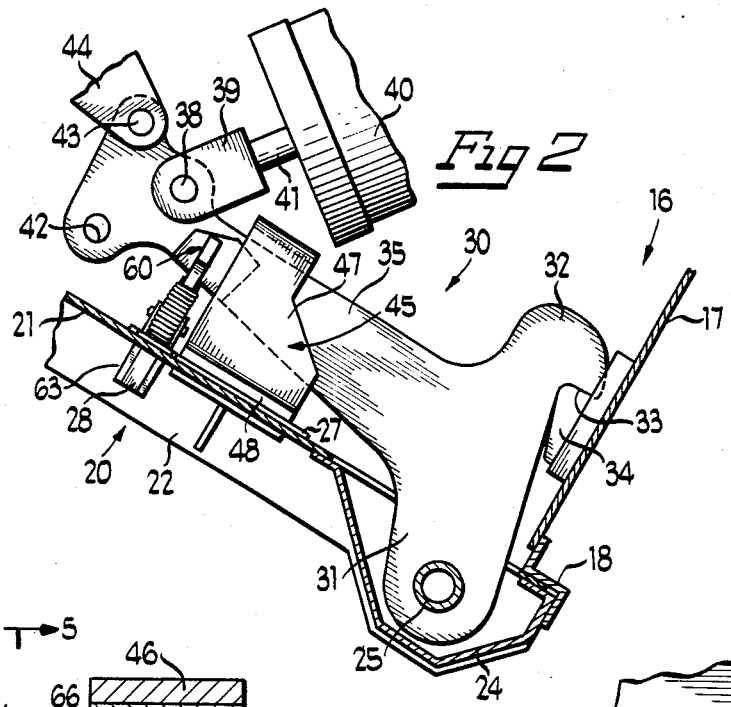
Fig 2
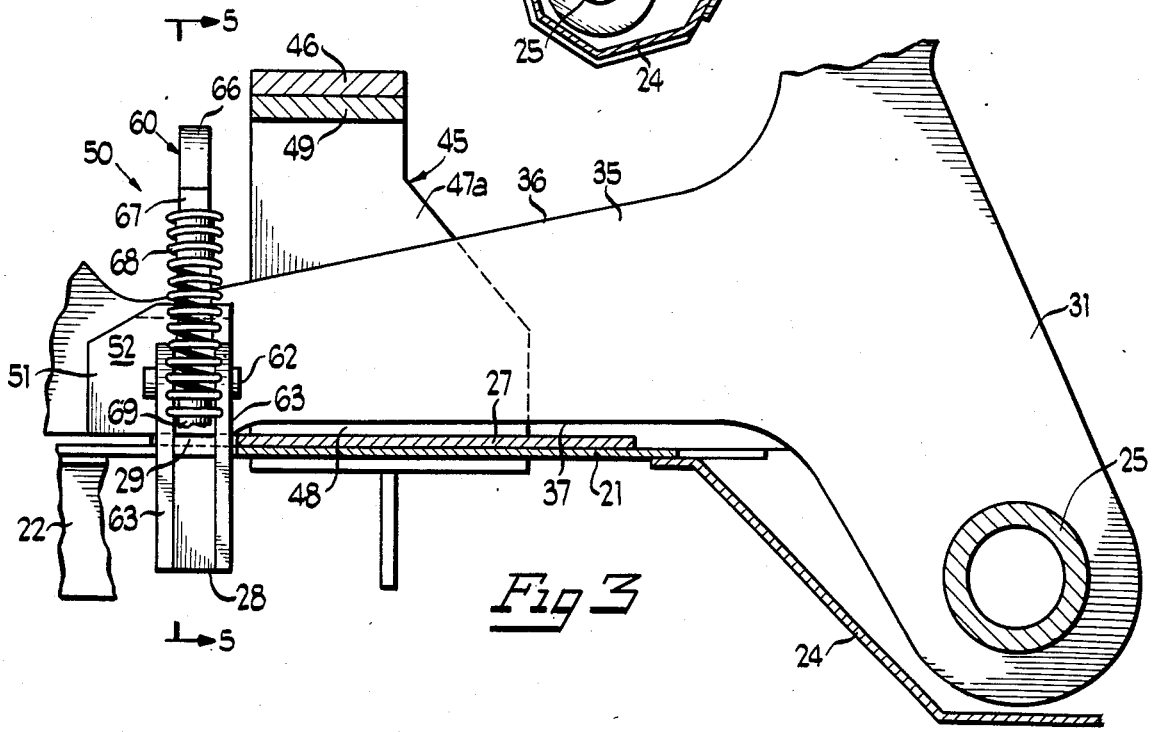
Fig 3

DOOR LATCH CONTROL APPARATUS FOR HOPPER VEHICLE

BACKGROUND OF THE INVENTION

The present invention relates to bottom-opening hopper vehicles, and particularly railway freight hopper cars. The invention specifically relates to latching means for the hopper doors of such a hopper vehicle.

The present invention is an improvement of the door latch mechanism disclosed in U.S. Pat. No. 3,931,768, assigned to the assignee of the present invention, the disclosure of which patent is incorporated herein by reference. The door latch mechanism disclosed in that patent is a spring-loaded toggle device. The spring force is intended to keep the door latch in the latching configuration when the door is closed and in the unlatching configuration when the door is open. An air cylinder powers both the door and the door latch mechanism.

Thus, to unlatch the door, the air cylinder piston extends and overpowers the latch spring. Then, the door weight, the lading weight and the cylinder force combine to open the door. In closing the door, the cylinder piston retracts, the strength of the latch spring being such that the door closes but the door latch mechanism is held in its unlatching configuration until the door is completely closed. At this point the continued force exerted by the retracting cylinder piston overpowers the latch spring and toggles it to drive the door latch to its latching configuration.

In this prior apparatus, it is imperative that the door latch be held in its unlatching configuration until the door is completely closed, otherwise the door will not properly seat. The latch spring alone holds the latch in its unlatching configuration during the door closure. Thus, a weak spring, unusually high door friction or an obstacle such as a piece of lading stuck to the door or in the path of the door might cause the latch spring to be overridden prematurely, resulting in the latch moving to its latching configuration before the door is closed. When this happens, the door latch interferes with the proper seating of the door. Increasing the latch spring force would help to alleviate this problem, but in that case a higher cylinder force and air pressure would be required to latch the door. This is disadvantageous because air pressure is normally limited by the locomotive or track side supply available. Furthermore, the criticality of the latch spring force dictates strict control of the spring quality and production assembly, adding to the costs of manufacture.

SUMMARY OF THE INVENTION

It is a general object of this invention to provide an improved latch control mechanism for a hopper door which avoids the disadvantages of prior latch mechanisms while affording additional structural and operating advantages.

An important object of the invention is the provision of latching apparatus for a hopper door which facilitates proper door seating on closure while minimizing the power necessary to close the door.

Still another object of this invention is the provision of latching apparatus of the type set forth, which is of simpler and more economical construction while ensuring proper latching operation.

It is another object of this invention to provide latching apparatus of the type set forth, which effectively prevents the latch mechanism from interfering with proper seating of the door on closure.

Yet another object of the invention is the provision of a latching apparatus of the type set forth, wherein the door latch is prevented from moving to its latching configuration except when the door is closed.

These and other objects of the invention are attained by providing latching apparatus for a hopper vehicle door movable between open and closed positions, the apparatus comprising door latch means movable between a latching configuration for latching the door in its closed position and an unlatching configuration for accommodating movement of the door between its open and closed positions, and secondary latch means movable between a latched condition for holding the door latch means in its unlatching configuration and an unlatched condition for accommodating movement of the door latch means between the latching and unlatching configurations thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a side elevational view of a railway hopper car incorporating door latching apparatus constructed in accordance with and embodying the features of the present invention;

FIG. 2 is an enlarged, fragmentary view in vertical section, taken along the line 2—2 in FIG. 1, and illustrating the latching apparatus of the present invention in its latching configuration latching the hopper door in its closed position;

FIG. 3 is a further enlarged, fragmentary sectional view of the latching apparatus of FIG. 2, rotated about 45 degrees counterclockwise, with the door latch held in its unlatching configuration;

DESCRIPTION OF THE PREFERRED EMBODIMENT

Figure 4:
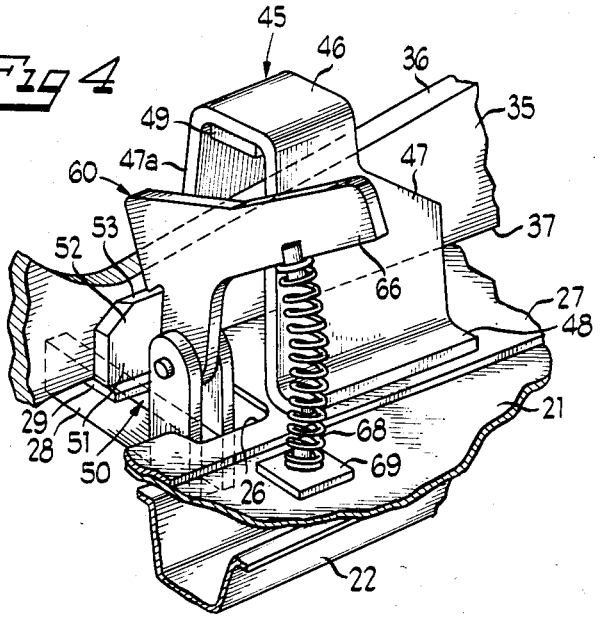
FIG. 4 is a fragmentary perspective view of the latching apparatus of the present invention in the configuration illustrated in FIG. 3.

Referring to FIG. 1 of the drawings, there is illustrated a hopper car, generally designated by the numeral 10, which includes a hopper body 11 supported on an elongated center sill 12 connected at the opposite ends thereof to two trucks 13. The hopper body 11 includes parallel side walls 14 and sloping end walls 15 which are closed at the lower ends thereof by two hopper bottoms 16 (one shown), respectively disposed on opposite sides of the center sill 12. More specifically, each of the hopper bottoms 16 includes a downwardly and laterally outwardly sloping center ridge sheet 17 (see FIG. 2) provided along the lower edge thereof with an elongated seat member 18, generally Z-shaped in transverse cross section. Respectively extending along the lower edges of the side walls 14 are two intermediate side sills 19 to which are respectively connected two door assemblies, generally designated by the numeral 20 (one shown). The door assemblies 20 are substantially mirror images of each other, so only one will be described.

Referring now also to FIGS. 2 through 6, each of the door assemblies 20 includes an elongated, generally rectangular panel 21 provided with transverse stakes 22 on the outer surface thereof, the door assembly 20 being hingedly connected by hinge assemblies 23 to the associated intermediate side sill 19 for pivotal movement between an open position, for emptying of the hopper car and a closed position (FIGS. 1 and 2) seated against the associated seat member 18 for cooperation therewith and with the associated center ridge sheet 17 for closing the associated hopper bottom 16. Each door panel 21 is provided along its lower edge with a longitudinally extending lower chord 24 through which extends an elongated torsion bar 25 which is rotatably movable about the axis thereof. The door panel 21 is provided with an opening 26 (FIGS. 4 and 5) therein midway between the opposite ends thereof and spaced a slight distance from the lower edge thereof for a purpose to be explained more fully below. Also, there is provided along the inner surface of the door panel 21 a reinforcing plate 27. Extending normal to the stakes 22 along the outside of the door panel 21 and spanning the opening 26 is a stiffener 28 having a striker plate 29 secured to the upper edge thereof in the opening 26.

Each door assembly 20 is provided with a door latch assembly, generally designated by the numeral 30, which includes a latch member 31 fixedly secured to the torsion bar 25 for pivotal movement about the axis thereof as the torsion bar 25 rotates. The latch member 31 is provided with a latch lug 32 having a latch surface 33 disposed for latching engagement with a keeper 34 fixedly secured to the inner surface of the associated center ridge sheet 17 (see FIG. 2). Additional latching lugs (not shown) may also be connected to the torsion bar 25 for pivotal movement therewith adjacent to the opposite ends thereof, as is explained in greater detail in the aforementioned U.S. Pat. No. 3,931,768.

The latch member 31 includes an elongated lever arm 35 having an upper edge 36 and a lower edge 37 which extends over the striker plate 29, the lever arm 35 being pivotally coupled adjacent to the distal end thereof, as by a pivot pin 38, to a clevis 39 which is fixedly secured to the piston rod 41 of a fluid-actuated cylinder 40. The cylinder 40 is mounted in a suitable housing (not shown) on the hopper body 11. The lever arm 35 is also provided with a hole 42 (see FIG. 2) to facilitate manual operation of the door latch assembly 30 through the opening 26 in the event of loss of cylinder power. The lever arm 35 is also pivotally coupled by a pin 43 to a lever 44 which has its upper end slidably coupled to a pivot and which carries a latch spring (not shown) which resiliently urges the lever 44 slidably toward the pivot pin 43. As is more fully explained in the aforementioned U.S. Pat. No. 3,931,768, the door latch assembly 30 comprises a toggle mechanism with the latch spring acting as an over-center spring. Thus, if the line interconnecting the axes of the torsion bar 25 and the pivot point of the upper end (not shown) of the lever 44 is considered as a center line, the latch spring tends to urge the pin 43 away from that center line, in one direction if the pin 43 is disposed on one side of that center line and in the other direction if the pin 43 is disposed on the other side of that center line.

The door latch assembly 30 also includes a generally inverted U-shaped retainer 45 having a bight 46 integral at the opposite edges thereof with two depending side plates 47 and 47(*a*), each provided at the lower end thereof with a laterally outwardly extending attachment flange 48 fixedly secured to the reinforcing plate 27 on the door panel 21. The retainer 45 straddles the lever arm 35 of the latch member 31, the underside of the bight 46 being provided with a pad 49 for engagement with the upper edge 36 of the lever arm 35 when the latch member 31 is in its latching configuration, illustrated in FIG. 2, for limiting and cushioning the movement of the latch member 31 to its latching configuration. When the latch member 31 is disposed in its unlatching configuration, illustrated in FIG. 3, the lower edge 37 of the lever arm 35 is disposed parallel to the door panel 21 with a distal end portion of the lower edge 37 being in engagement with the striker plate 29.

A fundamental aspect of this invention is the provision of a secondary latch assembly or lock assembly, generally designated by the numeral 50 for each door assembly 20. Each lock assembly 50 includes a keeper 51 fixedly secured to the lever arm 35 of the latch member 31 and provided with a flat outer bearing face 52 substantially parallel to the lever arm 35. The keeper 51 is provided along its upper edge with a lock surface 53 which slopes downwardly toward the adjacent side surface of the lever arm 35 (see FIGS. 4–6). The lock assembly 50 also includes an actuator plate 55 which is fixedly secured to a wall 56 of the housing for the cylinder 40 and extends therefrom substantially perpendicular thereto in cantilever fashion. The actuator plate 55 may also be connected to a gusset 58 which is, in turn, connected to a reinforcing bar 57 on the wall 56. The actuator plate 55 is provided on its underside adjacent to its distal end with a bearing pad 59.

The lock assembly 50 also includes a secondary latch or lock member, generally designated by the numeral 60, which has an elongated leg 61 fixedly secured to a pivot pin 62 which is mounted for pivotal rotation in a pair of spaced apart bearing blocks 63 which extend outwardly through the opening 26 and are respectively fixedly secured to opposite sides of the stiffener 28. The lock member 60 has a lock surface 64 (FIG. 6) which projects from the leg 61 at an angle to the longitudinal axis of the leg 61 and is disposed for mating locking engagement with the lock surface 53 of the keeper 51, as will be explained more fully below. The lock member 60 is also provided with a flat bearing surface 65 which intersects the lock surface 64. The lock member 60 also has an elongated lever arm 66 which extends beneath the actuator plate 55. The lever arm 66 is provided intermediate its ends with a retainer 67 for retaining one end of a helical compression spring 68, the other end of which is retained on a retainer 69 fixedly secured to the door panel 21. Thus, it will be appreciated that the spring 68 resiliently urges the lock member 60 into rotation in a counterclockwise direction, as viewed in FIGS. 5 and 6, toward a latched condition.

Figure 6:
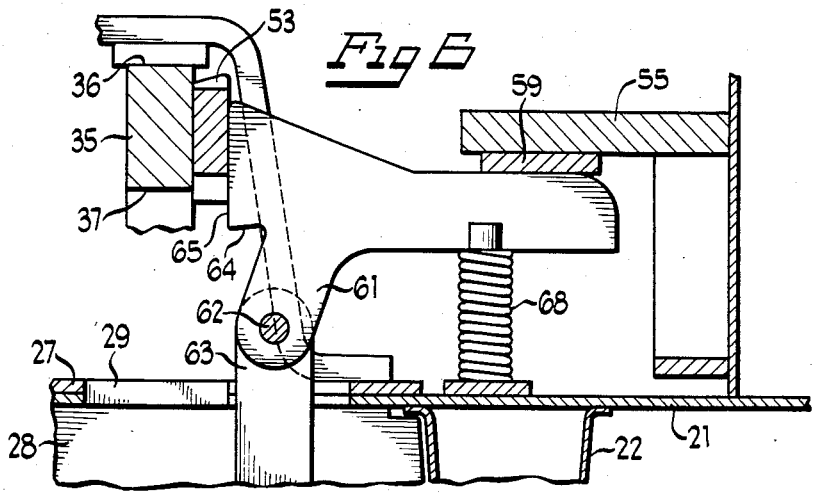
FIG. 6 is a view similar to FIG. 5, and illustrating the door latch in its latching configuration and the secondary latch in its unlatched condition.

The operation of the lock assembly 50 in connection with the door latch assembly 30 will now be described in detail. When the door assembly 20 is latched in its closed position, illustrated in FIGS. 2 and 6, the lever arm 35 of the latch member 31 bears against the pad 49 of the retainer 45. The lock member 60 is held in an unlatched condition by the actuator plate 55, against the urging of the compression spring 68, with the bearing surface 65 disposed in flush sliding engagement with the bearing face 52 of the keeper 51, as is best illustrated in FIG. 6. When the door assembly 20 is to be opened, the cylinder 40 is actuated to extend is piston rod 41, which first overpowers the latch spring of the door latch assembly 30 in a known manner, toggling the latch member 31 to is unlatching configuration out of engagement with the keeper 34, for permitting pivotal movement of the door assembly 20 from its closed position to its open position.

As the latch member 31 is pivoted to its unlatching configuration, illustrated in FIGS. 3–5, by the operation of the cylinder 40, the keeper 51 slides down along the bearing surface 65 of the lock member 60 until, when the latch member 31 arrives in its fully unlatching configuration, the keeper 51 is disposed entirely below the lock surface 64 of the lock member 60. However, the lock member 60 is still held in its unlatched condition by the actuator plate 55. When the door assembly 20 has thus been unlatched, its weight, plus the weight of the lading in the hopper car 10, cooperate with the action of the cylinder 40 to move the door assembly 20 to its fully open position in a known manner.

Figure 5:
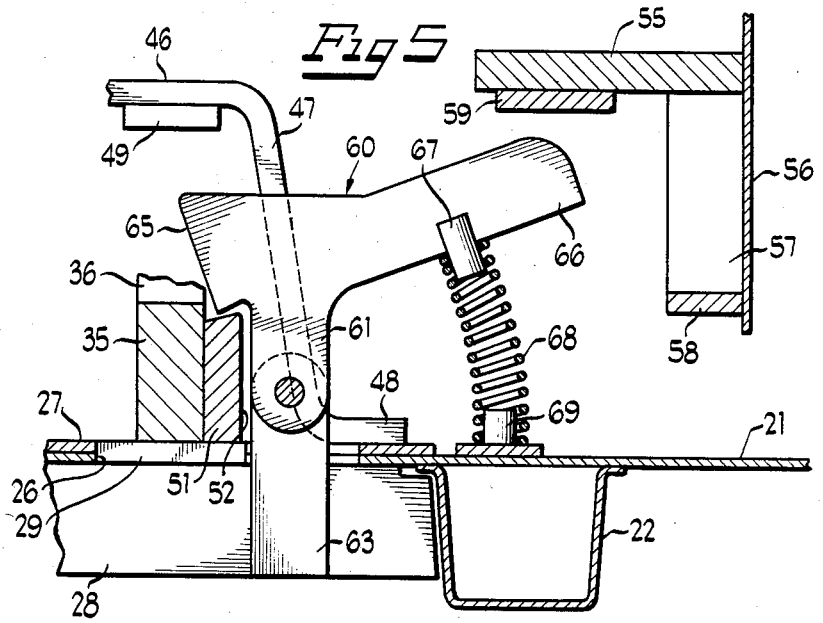
FIG. 5 is a reduced fragmentary view in vertical section taken along the line 5—5 in FIG. 3, and illustrating the actuator for the secondary latch.

As the door assembly 20 moves from its fully closed position it moves away from the actuator plate 55, thereby permitting the lock member 60 to be pivoted under the action of the bias spring 68 to its latched condition, illustrated in FIG. 5, wherein the lock surface 64 is disposed in locking engagement with the lock surface 53 of the keeper 51. The geometry of these locking surfaces 53 and 64 is such that any tendency of the latch member 31 to pivot back up from its unlatching configuration will impart negligible rotational or pivotal movement to the lock member 60. Thus, the lock member 60 is held in its latched condition by the bias spring 68 and effectively prevents movement of the latch member 31 from its unlatching configuration while the door assembly 20 is open.

When it is desired to close the door assembly 20, the cylinder 40 is actuated to retract its piston rod 41. The stiffness of the latch spring is such, in relationship to the weight of the door assembly 20, that the door assembly 20 will move toward its closed position before the latch spring is overcome, as is explained in the aforementioned U.S. Pat. No. 3,931,768. Thus, while the door assembly 20 is moving toward its closed position, the latch member 31 is held in its unlatching configuration by the latch spring. However, if the latch spring should become weakened or break, or if unusually high friction should develop in the door assembly 20, such as by rusting in the hinge assemblies 23 or the like, or if the effective weight of the door assembly 20 is increased because of lading stuck thereto, the latch spring may be overcome before the door assembly 20 is moved to its closed position. In such an event, however, the latch member 31 will still be securely held in its fully unlatching configuration by the lock assembly 50. Thus, the latch member 31 cannot move prematurely to its latching configuration, in which configuration it would interfere with the closure of the door assembly 20 and prevent its proper seating against the seat member 18. This permits the use of a latch spring of lesser strength and of less critical design than would otherwise be the case, and this in turn means that less power need be designed into the cylinder 40 for overcoming such a strengthened latch spring.

As the door assembly 20 approaches its fully closed position, the lever arm 66 of the lock member 60 engages the bearing pad 59 on the actuator plate 55 for pivoting the lock member 60 back to its unlatched condition, the parts being designed so that the lock member 60 will not reach its fully unlatched condition until the door assembly 20 is in its fully closed position, firmly seated against the seat member 18. When the door assembly 20 has thus been closed, the continued operation of the cylinder 40 will then overpower the latch spring and toggle the latch member 31 back to its latching configuration in latching engagement with the keeper 34. In the event that the latch spring has already been overcome by the cylinder 40, the latch member 31 will still not be permitted to pivot to its latching configuration until the door assembly 20 has substantially reached its fully closed position, since it is not until this point that the latch member 31 will have been released by the lock assembly 50. Accordingly, the operation of the door latch assembly 30 is effectively controlled by the lock assembly 50, and the operation of the lock member 60 is controlled by the bias spring 68 and the actuator plate 55.

Thus, it can be appreciated that there has been provided an improved latching apparatus which effectively prevents movement of the door latch assembly 30 except when the door assembly 20 is substantially in its fully closed position. More importantly, this apparatus prevents premature movement of the door latch assembly 30 to its latching configuration until the door assembly 20 is closed, thereby preventing interference by the door latch assembly 30 with the proper seating of the door assembly 20. In addition, there has been provided an improved latching apparatus which is operable in response to the movement of the door assembly 20 so that movement of the door assembly 20 to its closed position frees the door latch assembly 30 for movement while movement of the door assembly 20 from its closed position locks the door latch assembly 30 in its unlatching configuration.

Furthermore, the present invention, by providing positive control of the door latch assembly 30, permits the construction of the door latch assembly 30 to be simplified, eliminating a separate lever and spring assembly which was necessary in the device of the aforementioned U.S. Pat. No. 3,931,768.

I claim:

1. Latching apparatus for a hopper vehicle door movable between open and closed positions with respect to a fixed keeper, said apparatus comprising a door latch member pivotally movable about a first axis between a latching configuration engageable with the keeper for positively locking the door in its closed position and an unlatching configuration for accommodating movement of the door between its open and closed positions, a secondary latch member mounted on the door and pivotally movable about a second axis perpendicular to said first axis between a latched condition for holding said door latch member in its unlatching configuration and an unlatched condition for accommodating movement of said door latch member between the latching and unlatching configurations thereof, and control means independent of the keeper and responsive to movement of the door from its closed position for moving said secondary latch means to its latched condition and responsive to movement of the door to its closed position for effecting movement of said secondary latch member to the unlatched condition thereof.

2. The latching apparatus of claim 1, and further comprising a secondary keeper carried by said door latch member, said secondary latch member being engageable with said secondary keeper.

3. The latching apparatus of claim 2, wherein said secondary latch member has a first latch surface and said secondary keeper has a second latch surface matingly engageable with said first surface in the latched condition of said secondary latch member, said first and second latch surfaces being shaped and arranged so as to minimize forces tending to move said secondary latch member to the unlatched condition thereof.

4. The latching apparatus of claim 1 and further including stop means engageble with said door latch member in the latching configuration thereof for limiting the movement thereof;

5. The latching apparatus of claim 1, wherein said control means includes bias means resiliently urging said secondary latch member toward the latched condition thereof.

6. The latching apparatus of claim 5, wherein said control means further includes an actuator engageable said secondary latch member when the door is moved to its closed position for moving said secondary latch member to the unlatched condition thereof against the urging of said bias means.

7. The latching apparatus of claim 1, wherein said secondary latch member includes a lever portion, said control means including bias means engageable with said lever portion for resiliently urging said secondary latch member toward the latched condition thereof.

8. The latching apparatus of claim 1, wherein said door latch member in the latching configuration thereof is engageable with said secondary latch member for holding it in its unlatched condition.

9. In a hopper vehicle including a hopper door movable between open and closed positions and door latch mechanism on the door pivotally movable about a first axis between a latching configuration for engagement with a fixed keeper on the hopper vehicle to positively lock the door in its closed position and an unlatching configuration accommodating movement of the door between its open and closed positions, the improvement comprising: secondary latch means on the door pivotally movable about a second axis perpendicular to said first axis between a latched condition for holding the door latch mechanism in its unlatching configuration and an unlatched condition accommodating movement of the door latch mechanism between its latching and unlatching configurations, and control means independent of the keeper and responsive to movement of the door from its closed position for moving said secondary latch means to its latched condition and responsive to movement of the door to its closed position for moving said secondary latch means to its unlatched condition, whereby the door latch mechanism is held in its unlatching configuration when the door is not in its closed position.

10. The hopper vehicle of claim 9, wherein said secondary latch means includes a secondary keeper carried by the door latch mechanism and a latch member engageable with said secondary keeper in the latched condition of said secondary latch means.

11. The hopper vehicle of claim 9, wherein said control means includes bias means resiliently urging said secondary latch means toward the latched condition thereof, and an actuator engageable with said secondary latch means when the door is moved to its closed position for moving said secondary latch means to the unlatched condition thereof against the urging of said bias means.

12. The hopper vehicle of claim 9, and further including stop means engageable with the door latch mechanism in the latching configuration thereof for limiting the movement thereof.

* * * * *